US007553206B2

(12) United States Patent
Hasegawa et al.

(10) Patent No.: US 7,553,206 B2
(45) Date of Patent: Jun. 30, 2009

(54) OUTBOARD MOTOR

(75) Inventors: Hiroyuki Hasegawa, Shizuoka-ken (JP); Yukio Takeda, Shizuoka-ken (JP); Hideto Arai, Shizuoka-ken (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 64 days.

(21) Appl. No.: 11/735,899

(22) Filed: Apr. 16, 2007

(65) Prior Publication Data

US 2007/0243777 A1 Oct. 18, 2007

(30) Foreign Application Priority Data

Apr. 14, 2006 (JP) ..... 2006-111544

(51) Int. Cl.
*B60W 10/04* (2006.01)
*B63H 21/21* (2006.01)
*B63H 21/22* (2006.01)

(52) U.S. Cl. ..... 440/84; 440/85; 440/86; 440/87

(58) Field of Classification Search ..... 440/84–87
See application file for complete search history.

(56) References Cited

U.S. PATENT DOCUMENTS 5,545,064 A * 8/1996 Tsunekawa et al. ..... 440/53
6,406,343 B2 * 6/2002 Kawai et al. ..... 440/86
7,442,104 B2 * 10/2008 Okabe ..... 440/86

FOREIGN PATENT DOCUMENTS

JP 2000-213380 8/2000
JP 04-260892 9/2004

* cited by examiner

*Primary Examiner*—Lars A Olson
*Assistant Examiner*—Daniel V Venne
(74) *Attorney, Agent, or Firm*—Keating & Bennett, LLP

(57) ABSTRACT

An outboard motor has a throttle actuator adapted to control an amount of intake air supplied to an engine, and a shift mechanism that controls shift operation between a neutral and at least a forward gear. The throttle actuator includes a member that is adapted to interfere with the shift mechanism so as to prevent shift actuation when the throttle is opened beyond a predetermined setting. As such, shift operation is prevented at high throttle openings, but throttle operation is still enabled.

12 Claims, 8 Drawing Sheets

[FIG. 1]
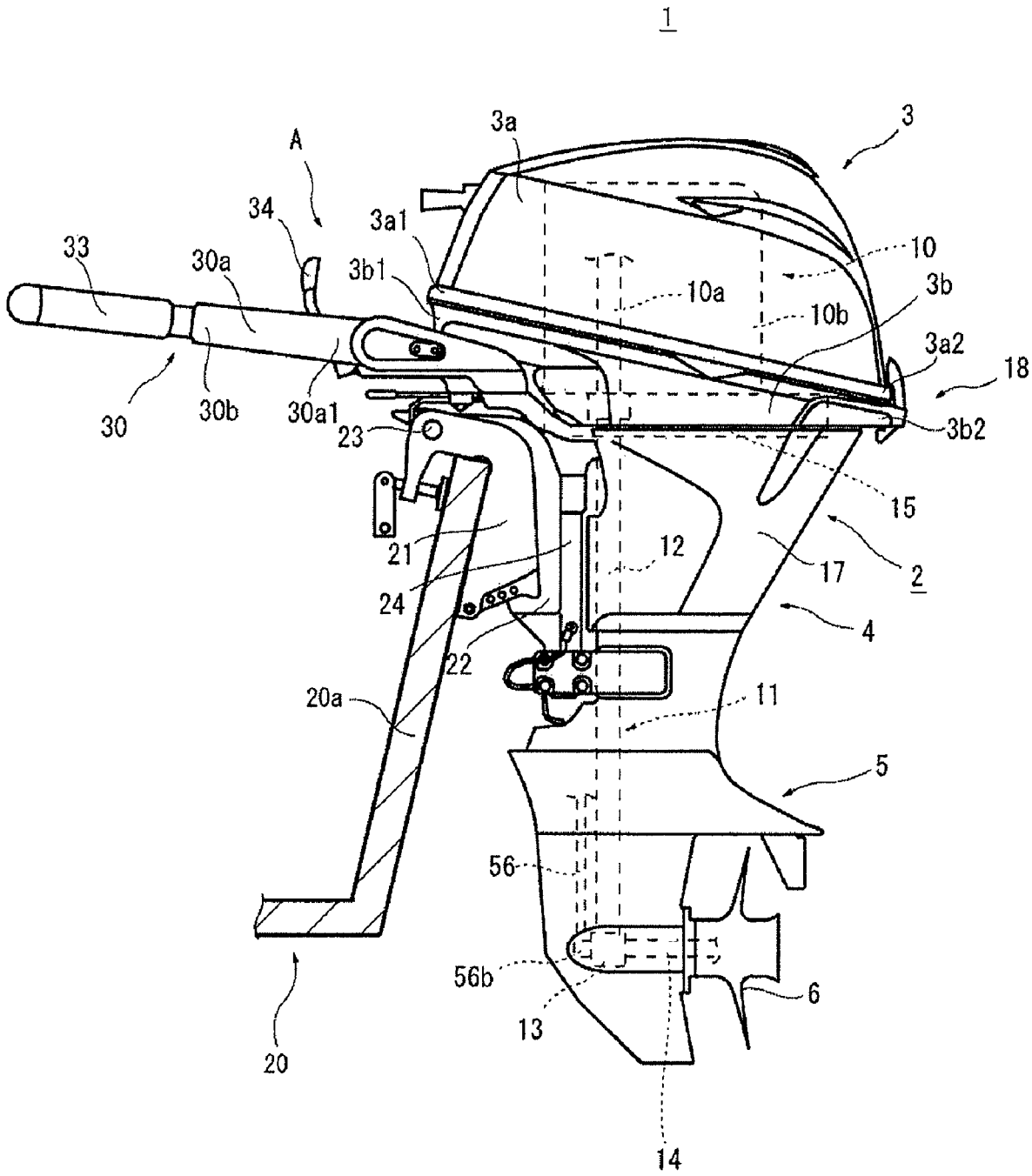

[FIG. 2]
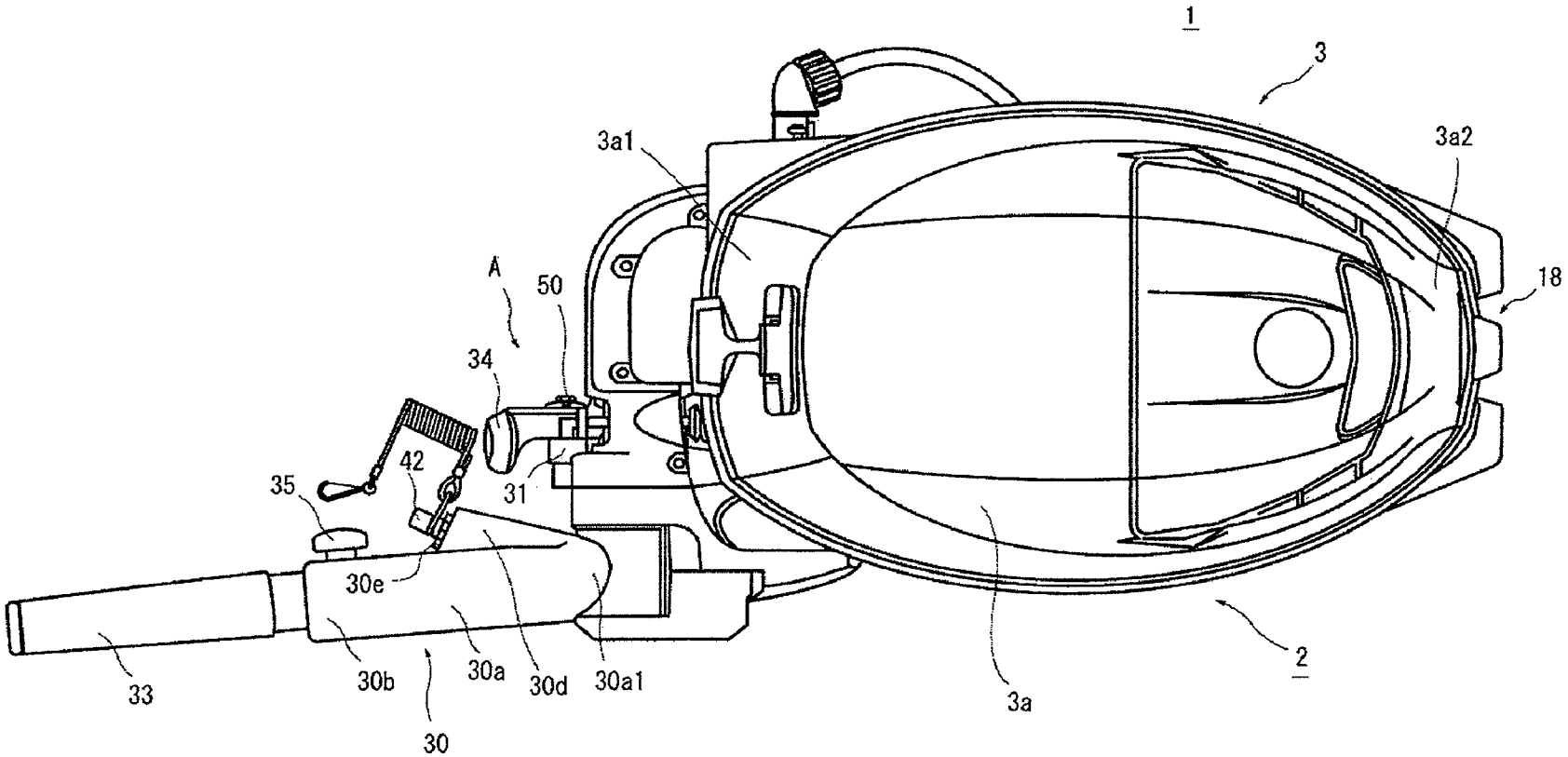

[FIG. 3]
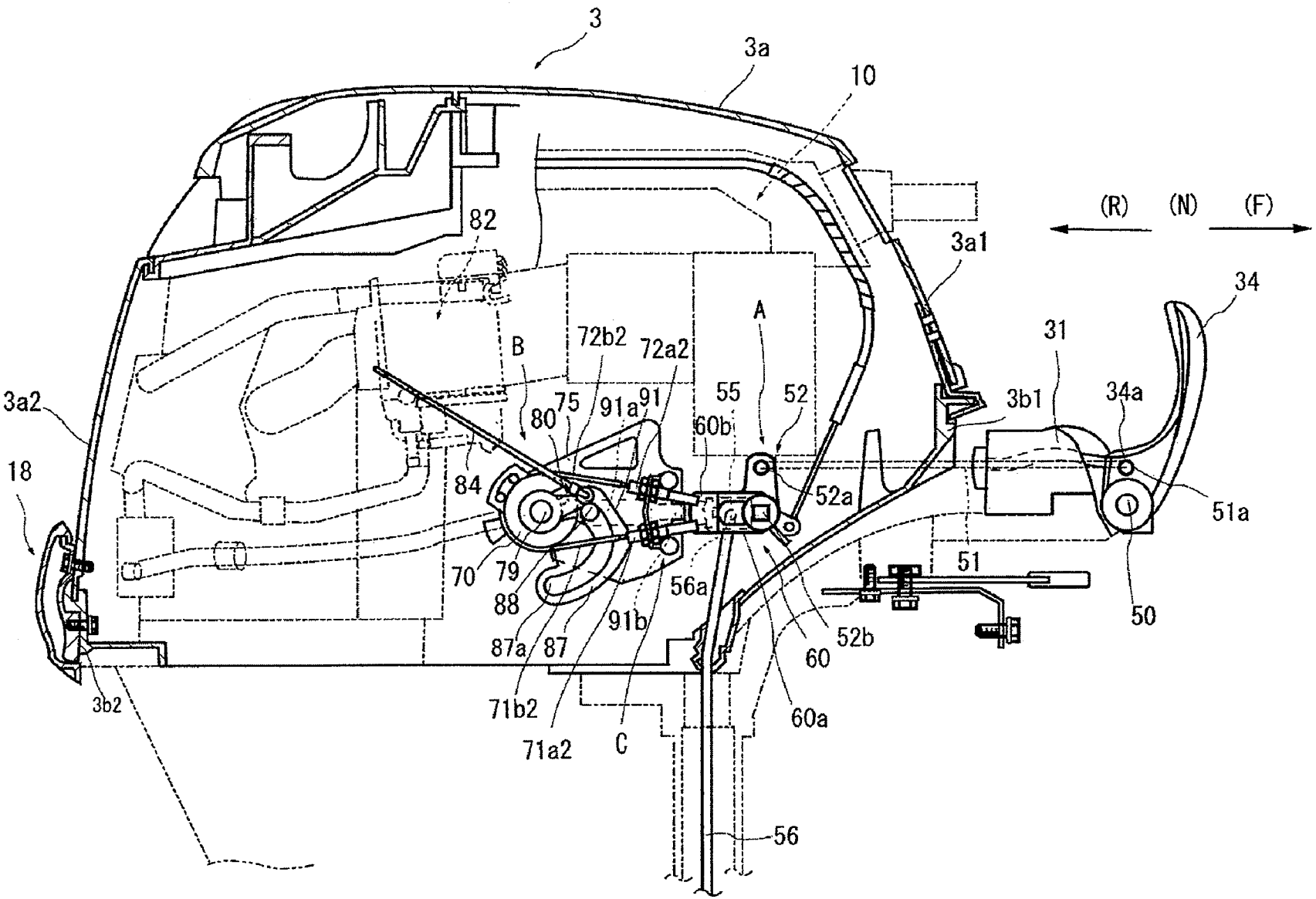

[FIG. 4]
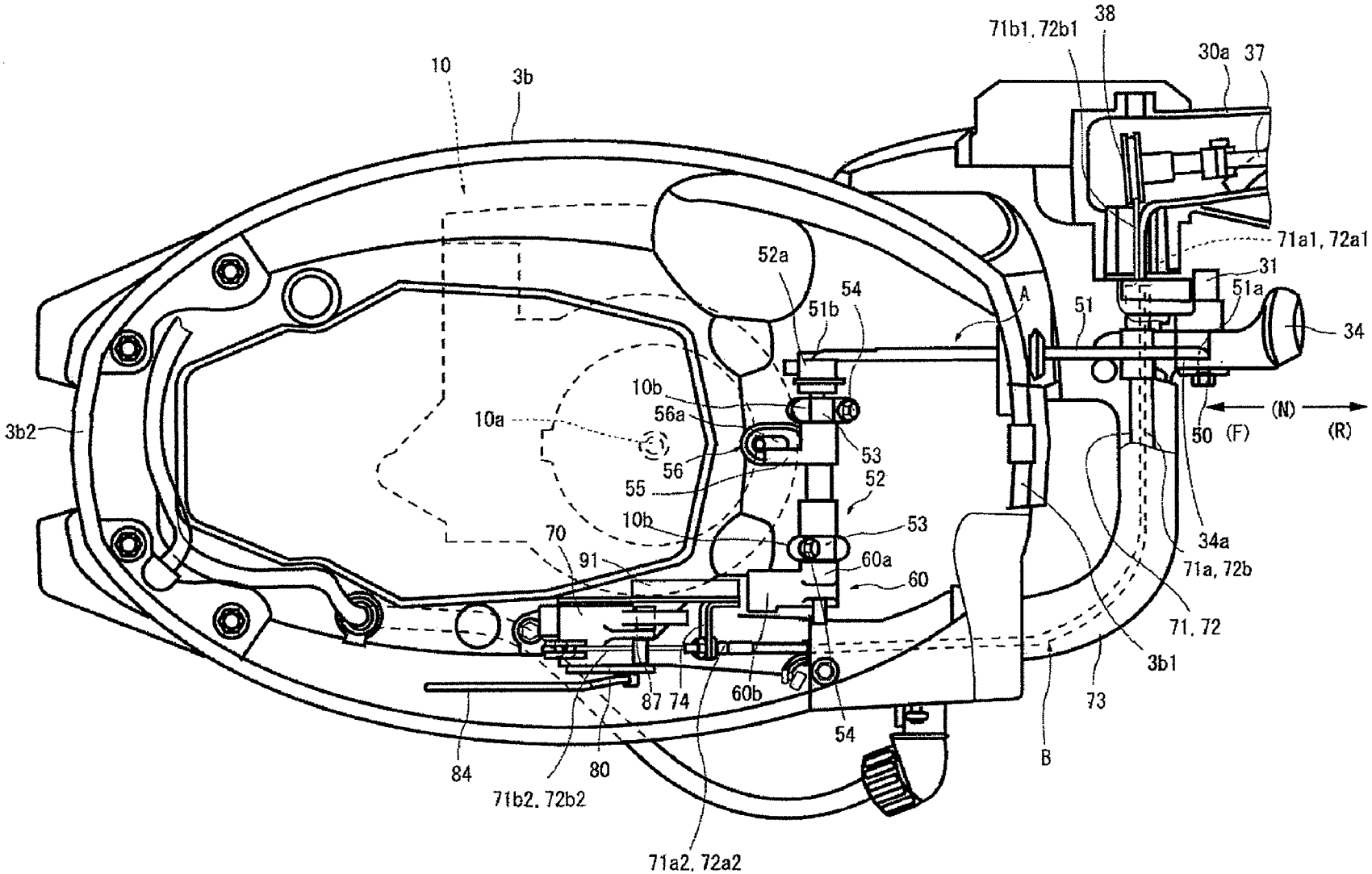

[FIG. 5]
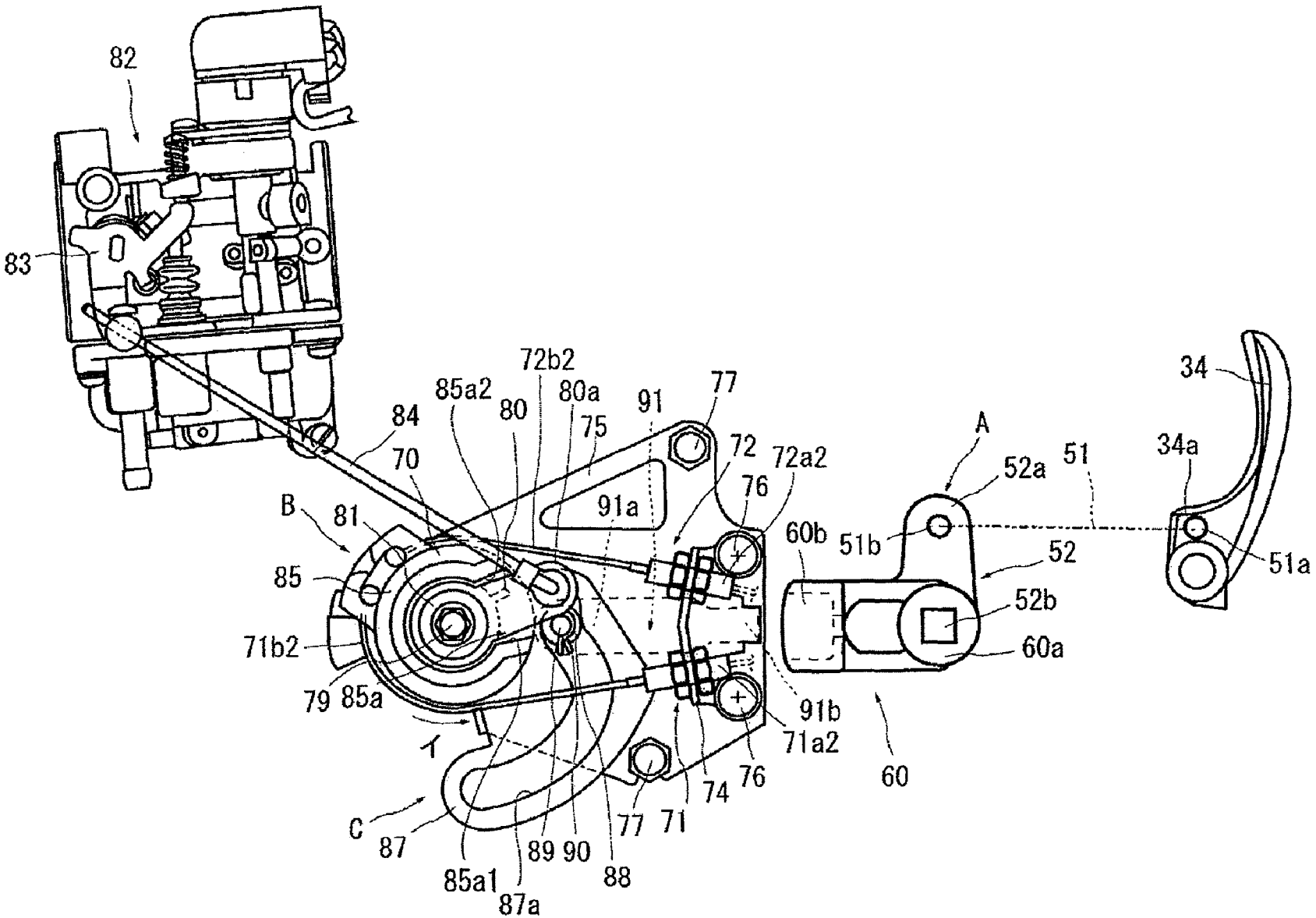

[FIG. 6]
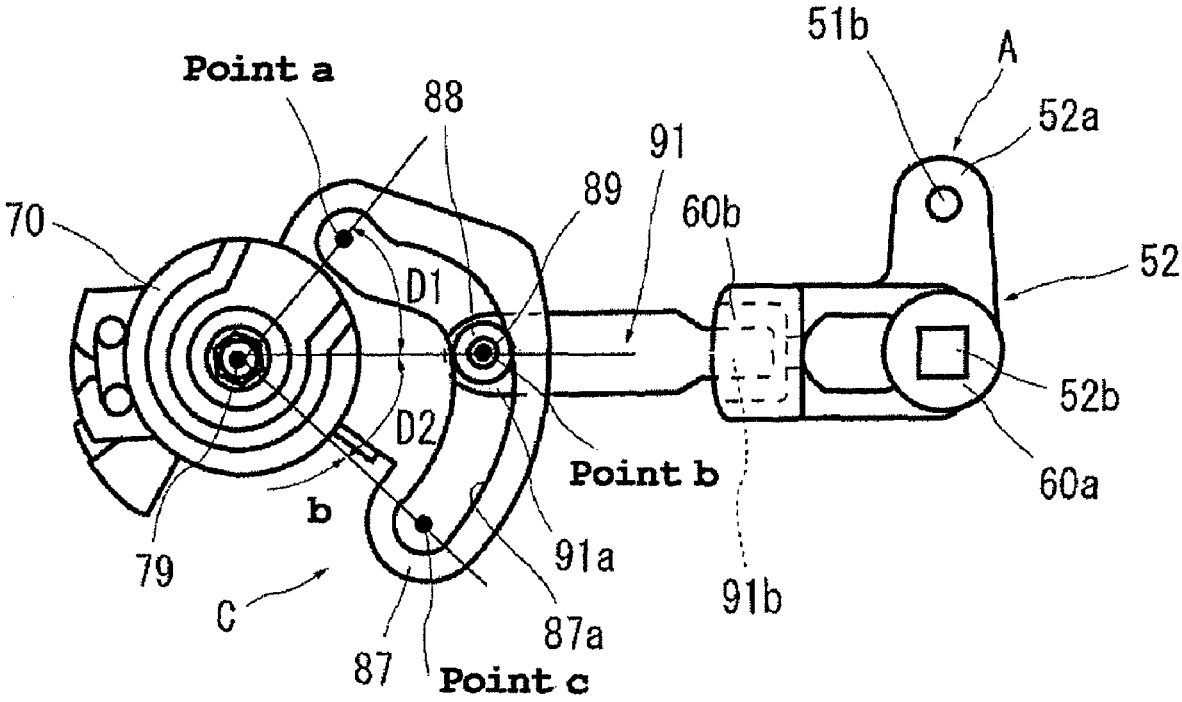

[FIG. 7]
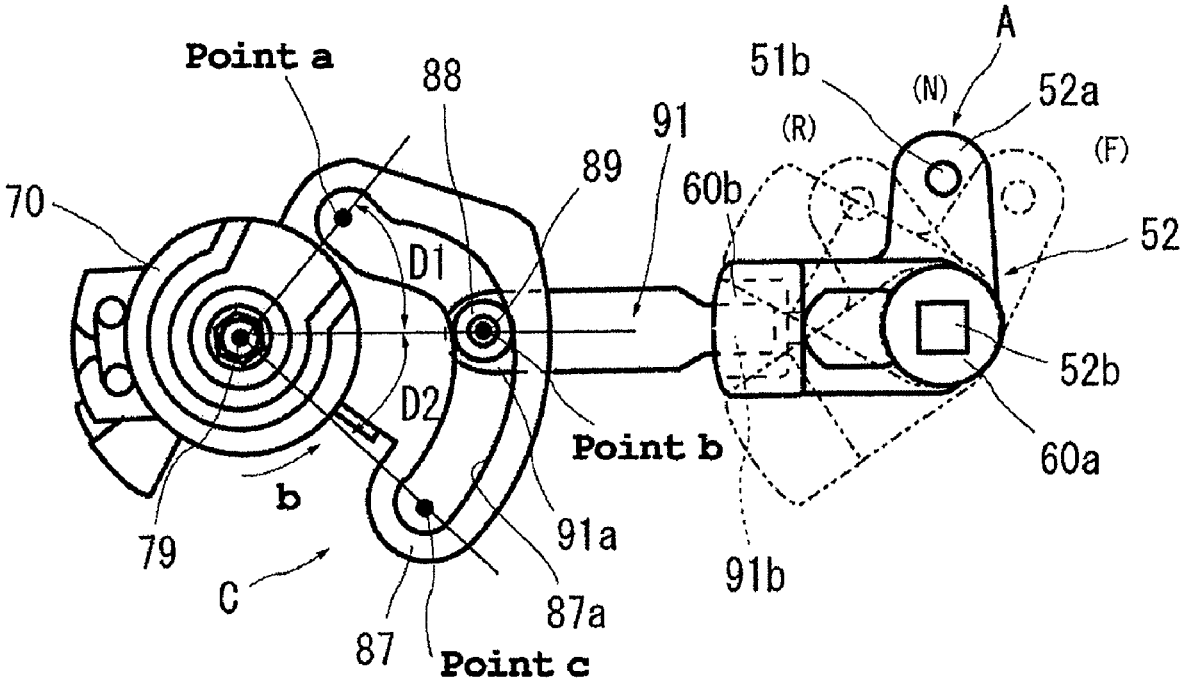

[FIG. 8]
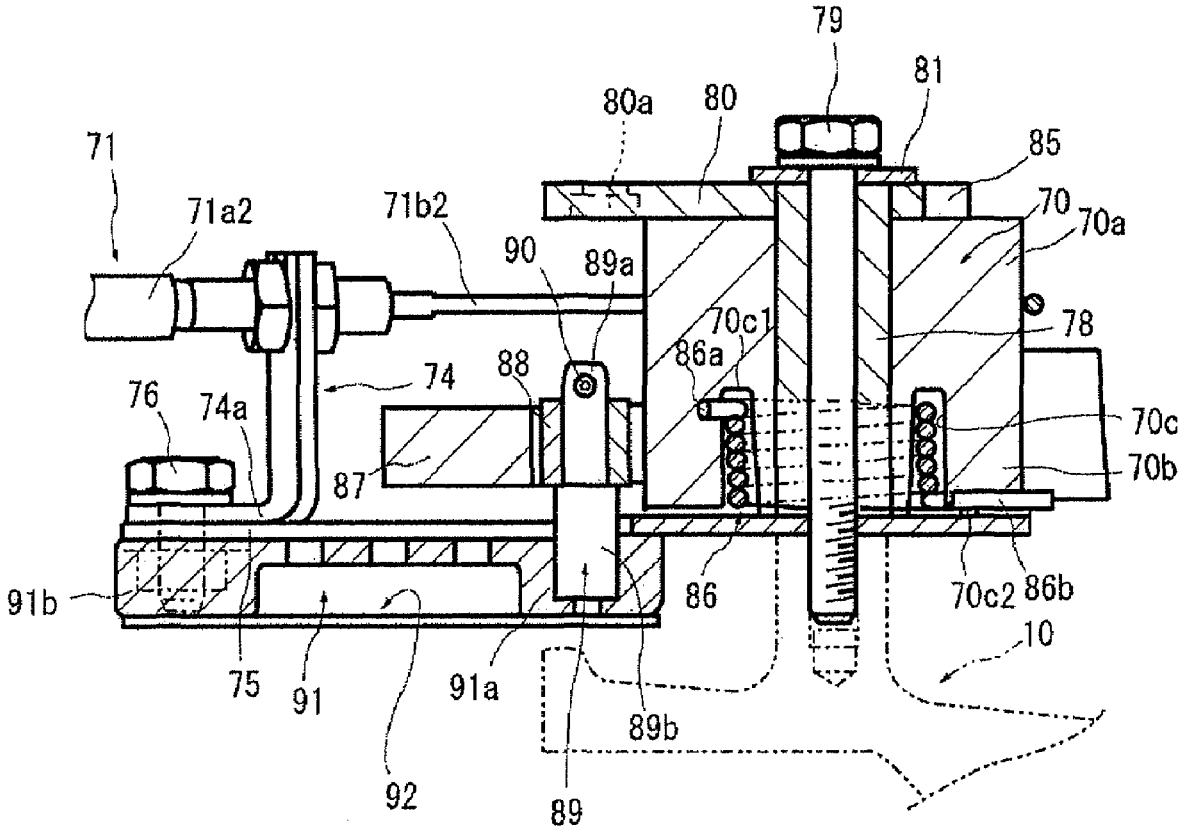

OUTBOARD MOTOR

CROSS-REFERENCE TO RELATED APPLICATIONS

The present application is based on and claims priority under 35 U.S.C. § 119 to Japanese Patent Application Serial No. 2006-111544, filed on Apr. 14, 2006, the entire contents of which are expressly incorporated by reference herein.

BACKGROUND OF THE INVENTION

1. Field of the Invention

The present invention relates to an outboard motor having a throttle and a gear shifter.

2. Description of the Related Art

Outboard motors typically have a throttle that controls the supply of air to the engine, and thus generally controls engine speed. Outboard motors also typically included a gear shifter for shifting between forward, neutral and reverse gears. If the throttle opening is increased when the shift position is the neutral position, that is, in the state where the engine is in a no-load state, the engine speed becomes extremely high, leading to various malfunctions. To avoid this, some outboard motors are equipped with a throttle opening regulating mechanism (see Japanese Patent Document JP-A-Hei 04-260892).

In an outboard motor, the engine is covered by a cowl, so the concentration of HC in the cowl often becomes high due to the drive of the engine. The throttle opening when the shift position is the neutral position is regulated in some conventional throttle opening regulating mechanisms. Thus, when the engine is to be started after warm-up, it is often difficult to start the engine if the concentration of HC in the cowl has become high, because the throttle opening regulation may not allow the user to increase the air intake amount sufficient to overcome the high HC concentration.

Some outboard motors are equipped with a shift operation regulating mechanism that permits throttle opening operation but disables shift operation when the shift position is the neutral position (see Japanese Patent Document JP-A-2000-213380). Such structure is disposed in a specially-constructed steering handle of the motor.

SUMMARY OF THE INVENTION

There is a need in the art for an outboard motor that allows throttle and shift operations to be performed separately, and protects the outboard motor from potentially-damaging shifts at high engine speeds. There is also a need in the art for an outboard motor that allows throttle and shift operations to be performed separately, irrespective of the configuration of a steering handle or the like of the motor.

In accordance with one embodiment, the present invention provides an outboard motor comprising an engine, a throttle mechanism, a shift mechanism, and a regulating mechanism. The throttle mechanism is adapted to control a throttle opening of the engine. The shift mechanism is configured to change a shift position of the outboard motor between at least a neutral state and a forward state. The regulating mechanism is configured so that when the shift mechanism is set to the neutral state and the throttle mechanism is set so that the throttle opening exceeds a predetermined value, the regulating mechanism restricts the shift mechanism from shifting out of the neutral state but permits unrestrained operation of the throttle mechanism. The regulating mechanism is further configured so that when the shift mechanism is set to a state other than the neutral state operation of the throttle mechanism remains unrestrained.

In a further such embodiment, the regulating mechanism does not restrict operation of the throttle mechanism in all states of the shift mechanism.

In another embodiment, the outboard motor comprises a cowl that encloses at least part of the regulating mechanism, at least part of the throttle mechanism, and at least part of the shifting mechanism. In a further such embodiment, a portion of the throttle mechanism within the cowl rotates about an axis, and a portion of the shift mechanism within the cowl rotates about an axis, and the throttle mechanism axis and shift mechanism axis are generally parallel to one another. In yet another such embodiment, the throttle mechanism is configured to be controlled by a throttle interface, and the throttle interface is disposed outside of the cowl. In yet another such embodiment, the shift mechanism is configured to be controlled by a shift interface, and the shift interface is disposed outside of the cowl.

In a still further embodiment, the throttle mechanism comprises a cam member having a cam portion. The cam member is adapted to rotate with a portion of the throttle mechanism. A plunger is operatively connected to the cam portion and adapted to move linearly as the cam member rotates. The shift mechanism has a regulating member having an engagement portion. The plunger is adapted to engage the engagement portion when the shift mechanism is in the neutral state and the throttle mechanism is rotated to a position beyond a predetermined setting corresponding to the throttle opening predetermined value. In another such embodiment, the cam portion is configured so that the plunger does not move substantially linearly when the throttle mechanism is rotated to a position beyond the predetermined setting corresponding to the throttle opening predetermined value.

In yet a further embodiment, the plunger does not engage the engagement portion when the shift mechanism is not in the neutral state, but is positioned to interfere with the regulating member when the throttle mechanism rotates beyond a predetermined setting corresponding to the throttle opening predetermined value.

In accordance with another embodiment of the present invention, an outboard motor is provided comprising an engine, a throttle mechanism, a shift mechanism, and a regulating mechanism. The throttle mechanism is adapted to control a throttle opening of the engine in response to a throttle operation means. The shift mechanism is configured to change a shift position of the outboard motor between at least a neutral state and a forward state in response to a shift operation means. The regulating mechanism is configured so that when the shift mechanism is set to the neutral state and the throttle mechanism is set so that the throttle opening exceeds a predetermined value, the regulating mechanism restricts the shift mechanism from shifting out of the neutral state but permits unrestrained operation of the throttle mechanism. The regulating mechanism is further configured so that when the shift mechanism is set to a state other than the neutral state operation of the throttle mechanism remains unrestrained.

In another such embodiment, the regulating mechanism comprises means for interfering with operation of the shift mechanism. A further such embodiment additionally comprises means for selectively actuating the interfering means only when the throttle opening exceeds the predetermined value.

BRIEF DESCRIPTION OF THE DRAWINGS

FIG. 1 is a side view of an outboard motor in accordance with one embodiment.

FIG. 2 is a plan view of the outboard motor of FIG. 1.

FIG. 3 is a longitudinal sectional view of the outboard motor of FIG. 1.

FIG. 4 is a cross sectional view of the outboard motor of FIG. 1.

FIG. 5 is a view showing a state in which the throttle is fully closed and the shift is in the neutral position.

FIG. 6 is a view showing a state in which the throttle is open and the shift is in the neutral position.

FIG. 7 is a view showing a state in which the shift is shifted from the neutral position.

FIG. 8 is a sectional view of a regulating mechanism portion.

DETAILED DESCRIPTION OF PREFERRED EMBODIMENTS

While an embodiment of an outboard motor according to the present invention will be described below, it is to be understood that this embodiment is merely illustrative of a preferred embodiment, and the present invention is not limited to the embodiments specifically discussed herein. In the illustrated embodiment, the front side of the outboard motor is taken as the hull side, the rear side of the outboard motor is taken as the side opposite to the hull side, and the vertical direction is taken as the up and down direction.

As shown in FIGS. 1 and 2, an outboard motor 1 has a propulsion unit 2. The housing portion thereof includes a cowl 3, an upper case 4, and a lower case 5. A four-cycle engine 10 with a vertically placed crankshaft 10*a* preferably is accommodated in the cowl 3 located in an upper part of the housing, and a propeller 6 that is rotationally driven by the engine 10 is provided to the lower case 5 located in a lower part of the housing. The engine 10 is placed with the crankshaft 10*a* positioned on the hull side and a cylinder 10*b* positioned on the side opposite to the hull side. A power transmission mechanism 11, an exhaust passage (not shown), and the like extending from the engine 10 preferably are accommodated in the portion from the upper case 4 at the center to the lower case 5. The propeller 6 is rotationally driven by the engine 10 via the power transmission mechanism 11. The power transmission mechanism 11 includes a drive shaft 12 coupled to the crankshaft 10*a*, a shift switching mechanism 13, a propeller shaft 14, and the like.

The cowl 3 forming an engine accommodating space preferably includes a top cowl 3*a* and a bottom cowl 3*b*, with an exhaust guide 15 being disposed at the top end of the upper case 4. The engine 10 is fixed onto the top surface of the exhaust guide 15.

The bottom cowl 3*b* preferably is secured by bolting to the peripheral edge portion of the upper surface of the exhaust guide 15. The upper end of the upper case 4 preferably is secured by bolting to the peripheral edge portion of the lower surface of the exhaust guide 15. An apron 17 is mounted so as to cover an upper portion of the upper case 4 and the periphery of the exhaust guide 15.

The top cowl 3*a* that covers the engine 10 from above is mounted from above so as to be freely open and closed with respect to the bottom cowl 3*b* secured to the exhaust guide 15. A front side portion 3*a*1 of the top cowl 3*a* is engaged with a front side portion 3*b*1 of the bottom cowl 3*b*, and a rear side portion 3*a*2 of the top cowl 3*a* is detachably coupled to a rear side portion 3*b*2 of the bottom cowl 3*b* via a clamping device 18.

The outboard motor 1 preferably is mounted to the rear end portion of a hull 20. A clamp bracket 21 is fixed to a rear plate 20*a* of the hull 20. A swivel bracket 22 is pivotally mounted on the clamp bracket 21 in a rotatable manner by a tilt shaft 23. The propulsion unit 2 is pivotally mounted on the swivel bracket 22 so as to be rotatable about a steering shaft 24.

With continued reference to FIGS. 1 and 2, a bracket 31 preferably is fixed to an upper front portion of the propulsion unit 2. A proximal end portion 30*a*1 of a handle housing 30*a* of a steering handle 30, which preferably is bent in an L shape from the front to the rear, is pivotally mounted on the bracket 31 so as to be vertically rotatable. In the illustrated embodiment, a throttle grip 33 is rotatably attached to a distal end portion 30*b* of the handle housing 30*a*. Further, a shift lever 34 that preferably extends upward from the center in the front-to-rear direction of the outboard motor 1 to the steering handle 30 side preferably is pivotally mounted on the bracket 31 so as to be rotatable forward and backward.

A throttle friction adjusting knob 35 preferably is pivotally mounted on the inner side surface of the handle housing 30*a* in a rotatable manner. Formed at a position close to the rear of the inner side surface of the handle housing 30*a* is a bulged portion 30*d* that preferably extends inward in an inverted V-shaped configuration at a predetermined angle. A stop switch 42 is attached to an inclined surface 30*e* of the bulged portion 30*d* on the throttle friction adjusting knob 35 side.

In the illustrated embodiment, the outboard motor 1 includes a shift mechanism A that is subjected to a shift operation to change the shift position. As shown in FIGS. 3 to 8, in the shift mechanism A, the shift lever 34 is supported on the bracket 31 so as to be rotatable about a rotary shaft 50, the shift lever 34 is coupled to a shift actuating member 52 via an operating rod 51, and the shift actuating member 52 rotates in synchronization with the shift operation of the shift lever 34. In the illustrated embodiment, the coupling between the shift lever 34 and the shift actuating member 52 is effected by engaging one end portion 51*a* of the operating rod 51 with a proximal portion 34*a* of the shift lever 34, and by engaging one end portion 51*b* with a boss portion 52*a* at an end of the shift actuating member 52. The shift lever 34 is shown in the neutral position (N) in FIGS. 3 and 4. The shift lever 34 is shifted to the forward position (F) when pulled frontward from this neutral position (N), and is shifted to the reverse position (R) when pushed to the rear side.

As best shown in FIG. 4, the shift actuating member 52 preferably is held against two boss portions 10*b* provided on the front side of the engine 10, with fastening members 53 being rotatably supported in place by bolts 54, thereby placing the shift actuating member 52 in a generally horizontal direction orthogonal to the crankshaft 10*a*. An actuating link 55 is fixed to an intermediate portion of the shift actuating member 52. An upper end portion 56*a* of a shift rod 56 is locked onto the actuating link 55, and a lower end portion 56*b* of the shift rod 56 serves to actuate the shift switching mechanism 13 shown in FIG. 1.

In the illustrated embodiment, the operating rod 51 makes linear motion through the operation of the shift lever 34, and this linear motion of the operating rod 51 is converted into rotary motion by the shift actuating member 52, so the actuating link 55 causes the shift rod 56 to make linear motion in the vertical direction, and the shift rod 56 actuates the shift switching mechanism 13.

A proximal portion 60*a* of a regulating member 60 is provided at a distal end portion 52*b* of the shift actuating member 52 so as to be integrally rotatable therewith. The regulating member 60 preferably has a lock portion 60*b*. The lock portion 60*b* is formed in the shape of a hole in this embodiment. However, the present invention is not limited to this shape, and other configurations are contemplated, such as a groove-like shape, as long as the lock portion 60*b* is adapted to engage a plunger 91, which will be described later, so as to restrict the rotation of the shift actuating member 52.

The shift actuating member 52 preferably rotates in synchronization with a shift operation on the shift lever 34 of the shift operation means. As shown in FIG. 7, when the shift lever 34 is in the neutral position (N), the regulating member 60 is in the neutral position (N) as shown in FIG. 7. Upon rotating the shift lever 34 to the reverse position (R), the regulating member 60 is turned left to the reverse position (R) as shown in FIG. 7 via the operating rod 51 and the shift operation member 52, so the shift state of the shift switching mechanism 13 is switched to the reverse position (R). Conversely, upon shifting the shift lever 34 to the forward position (F), the regulating member 60 is turned right to the forward position (F) as shown in FIG. 7 via the operating rod 51 and the shift operation member 52, so the shift state of the shift switching mechanism 13 is switched to the forward position (F).

The illustrated outboard motor 1 includes a throttle mechanism B that is subjected to a throttle operation to control the amount of intake air supplied to the engine 10. As shown in FIGS. 3 to 8, the throttle mechanism B preferably comprises a throttle shaft 37 operated by the throttle grip 33 that is arranged in the inner portion of the handle housing 30*a*, and a drive pulley 38 provided to the distal end portion of the throttle shaft 37. The drive pulley 38 and a throttle actuating member 70 preferably are coupled to each other by throttle cables 71 and 72. The throttle cables 71 and 72 preferably are arranged inside a guide tube 73. In the illustrated embodiment, the throttle cables 71 and 72 include outer cables 71*a* and 72*a* and inner cables 71*b* and 72*b*, respectively. First end portions 71*a*1 and 72*a*1 of the outer cables 71*a* and 72*a* are fixed to the handle housing 30*a*, and second end portions 71*a*2 and 72*a*2 of the outer cables 71*a* and 72*a* are fixed to a support bracket 74. The first end portions 71*b*1 and 72*b*1 of the inner cables 71*b* and 72*b* are fixed to the drive pulley 38, and the second end portions 71*b*2 and 72*b*2 of the inner cables 71*b* and 72*b* are fixed to the throttle actuating member 70. In the illustrated embodiment, when the throttle shaft 37 is rotated by means of the throttle grip 33, the drive pulley 38 rotates, and in synchronization with this rotation, the throttle actuating member 70 is rotated via the inner cables 71*b* and 72*b*.

A proximal portion 74*a* of the support bracket 74 preferably is held onto a mounting plate 75, and is fastened onto the engine 10 together with a mounting bolt 76. Another portion of the mounting plate 75 is fastened onto the engine 10 with a mounting bolt 77.

The throttle actuating member 70 preferably is fastened onto the engine 10 via a collar 78 with a mounting bolt 79. A distal end portion 70*a* of the throttle actuating member 70 and an operating link 80 are fastened together via a washer 81. As best shown in FIG. 5, the operating link 80 and a throttle link 83 of a throttle device 82 preferably are coupled together by a throttle rod 84. The operation of the operating link 80 is transmitted to the throttle link 83 via the throttle rod 84, and the opening of the throttle valve of the throttle device 82 is adjusted via the throttle link 83. The throttle device 82 is arranged in the fuel supply path for the engine 10, and controls the amount of intake air to the engine 10.

A position adjusting member 85 preferably is provided at the distal end portion 70*a* of the throttle actuating member 70. A part of the position adjusting member 85 is exposed open, and the operating link 80 extends from this open portion 85*a*. An end portion of the throttle rod 84 is rotatably coupled to a distal end portion 80*a* of the operating link 80 that extends as described above. To adjust the assembly position between the throttle valve of the throttle device 82 and the throttle actuating member 70, first, in the state with the throttle valve of the throttle device 82 fully open, the throttle link 83 and the throttle rod 84 are assembled together. Then, with the throttle actuating member 70 set in the full open position, the throttle rod 84 and the operating link 80 are assembled together, and the assembly position is adjusted so that when the throttle valve of the throttle device 82 is fully opened, the operating link 80 that extends from the open portion 85*a* of the position adjusting member 85 does not abut side surfaces 85*a*1, 85*a*2 of the open portion 85*a*.

An annular hole 70*c* is formed at a proximal portion 70*b* of the throttle actuating member 70, and a coil spring 86 preferably is received in the annular hole 70*c*, as best shown in FIG. 8. A first end portion 86*a* of the coil spring 86 is locked onto a bottom portion 70*c*1 of the annular hole 70*c*, and a second end portion 86*b* is locked onto an entrance portion 70*c*2 of the annular hole 70*c*. The coil spring 86 applies an urging force so that the throttle actuating member 70 does not rattle, and urges the throttle actuating member 70 in the throttle closing direction.

The illustrated outboard motor 1 also includes a regulating mechanism C. When, in an operational state with the shift mechanism A set in the neutral position and the throttle opening exceeding a predetermined value D1, the regulating mechanism C is adapted to restrict shift operation of the shift mechanism A, but permit throttle operation. When the shift mechanism A is in a position other than the neutral position, the regulating mechanism C still permits a throttle operation.

In the illustrated embodiment, the throttle actuating member 70 includes a plate-like cam member 87 having a cam portion 87*a*. The cam member 87 is formed integrally with the throttle actuating member 70 in the illustrated embodiment. However, in other embodiments, the cam member 87 and the throttle actuating member 70 may be formed separately and then fixed to each other. In the illustrated embodiment, the cam portion 87*a* of the cam member 87 is formed in a groove-like configuration. A roller 88 is provided so as to engage with and move on the cam portion 87*a*. A connecting pin 89 is passed through the roller 88, and a clip 90 is provided to a distal end portion 89*a* of the connecting pin 89 to prevent detachment. A proximal portion 89*b* of the connecting pin 89 is press-fitted and fixed to a proximal portion 91*a* of the plunger 91. The plunger 91 moves along a guide groove 92 formed in the engine 10 so that its distal end portion 91*b* can become engaged with the lock portion 60*b* of the regulating member 60. The connecting pin 89 connects the roller 88 of the cam member 87 and the plunger 91 to each other. The plunger 91 converts rotation into linear motion by means of the roller 88 that engages with the cam portion 87*a* of the cam member 87, and the connecting pin 89. As such, the plunger 91 moves linearly sufficient to engage the lock portion 60*b* when the opening is at or near the predetermined value D1.

The cam portion 87*a* of the cam member 87 is formed so as to cause the plunger 91 to move in the manner as shown in FIGS. 5 to 7. FIG. 5 shows a state in which the throttle is fully closed and the shift is in the neutral position. In this state, the distal end portion 91*b* of the plunger 91 is not engaged with the lock portion 60*b* of the regulating member 60, so the shift operation can be performed without any interference by the plunger 91 with the lock portion 60. FIG. 6 shows a state in which the throttle is open, and the shift is in the neutral position. In this state, the plunger 91 has advanced so that the distal end portion 91*b* is engaged with the lock portion 60*b* of the regulating member 60. As such, the engaged plunger 91 and member 60 prevent rotation of the shift actuating member 52 so that the shift cannot be shifted from the neutral position. Although the throttle operation is permitted in the above-mentioned state where the shift cannot be shifted from the neutral position, this state continues until the throttle becomes fully open. That is, the shift cannot be shifted from the neutral position beginning at throttle position D1 and continuing to when the throttle becomes fully open D2. FIG. 7 shows (in phantom lines) states in which the shift is shifted from the neutral position to forward (F) or reverse (R) positions. In this state where the shift is not in the neutral position, a shift operation for freely opening or closing the throttle can be performed.

An example of actuation of the regulating mechanism C will be described with reference to FIGS. 5 to 7. As shown in FIG. 5, at the time of the start-up operation of the engine 10 of the outboard motor 1, the throttle is fully closed with the throttle opening being 0, and the shift is in the neutral position. When starting the engine after warm-up in this way, since the concentration of HC in the cowl formed by the top cowl 3*a* and the bottom cowl 3*b* has become high, it is often difficult to start the engine in this case. Accordingly, through throttle operation by the throttle operation means, the throttle actuating member 70 of the throttle mechanism B is rotated in the direction indicated by the arrow b. In synchronization with this rotation of the throttle actuating member 70, the cam member 87 rotates as shown in FIG. 6, causing the roller 88 to move from the point a to the point b in the cam portion 87*a* to open the throttle. When the roller 88 moves past the point b in the cam portion 87*a* due to this rotation of the throttle actuating member 70, the throttle opening exceeds a predetermined value D1, and the plunger 91 advances to bring its distal end portion 91*b* into engagement with the lock portion 60*b* of the regulating member 60, thereby restricting the rotation of the shift actuating member 52.

Since the distal end portion 91*b* of the plunger 91 is in engagement with the lock portion 60*b* of the regulating member 60 in this state, the shift cannot be shifted from the neutral position. In this state where the shift cannot be shifted from the neutral position, when the throttle is further opened, the roller 88 moves past the point b and may eventually reach the point c in the cam portion 87*a* as the throttle actuating member 70 rotates, so that the throttle gets to the fully open state D2. At this time, the plunger 91 remains in its advanced position, and the plunger 91 preferably does not substantially change its position even as the roller 88 moves from the point b to the point c in the cam portion 87*a*, until the throttle becomes the fully open state D2. Thus, the shift cannot be shifted from the neutral position in the throttle full open state D2.

As described above, the engine 10 includes the regulating mechanism C which, when the throttle opening exceeds the predetermined value D1 with the shift mechanism A being in the neutral position, restricts the shift operation of the shift mechanism A, while permitting the throttle operation, and which, when the shift mechanism A is in a position other than the neutral position, permits the throttle operation. Accordingly, the present invention is also applicable to an outboard motor with no shift operation means provided to the steering handle. The present invention is thus suitable for general-purpose use since it can be applied to the engine 10 irrespective of the configuration of the steering handle or the like. In addition, the present invention makes it possible to enhance the start-up property at the time of the start-up operation of the engine 10, and prevent a shift operation from being performed in a state where the engine speed is high.

Further, as shown in FIG. 7, in the throttle opening state, the shift position can be switched from the position (N) to the forward position (F) or the reverse position (R). That is, the shift position can be switched from the neutral position (N) to the forward position (F) or the reverse position (R) only in the state where the throttle opening is less than the predetermined value. The plunger 91 will also interfere with the rotation of the regulating member 60 so as to prevent shifting from the forward position (F) or the reverse position (R) to the neutral position (N) when the throttle opening is at or greater than the predetermined opening D1. As such, all shifting can be prevented at undesirably high throttle openings.

According to embodiments described herein, it is possible to improve the start-up behavior of the engine, and also prevent the shift operation from being performed in the state where the engine speed is high, by a simple structure of providing the engine 10 with the regulating member 60 which, when the throttle opening exceeds the predetermined value D1 in the state with the shift actuating member 52 being in the neutral position, moves in synchronization with the rotation of the throttle actuating member 70 to restrict and/or interfere with rotation of the shift actuating member 52. The embodiment adopts a simple structure of using the plunger 91 which, when the throttle opening exceeds the predetermined value D1, restricts the rotation of the shift actuating member 52 and converts the throttle actuation into linear motion as the distal end portion 91*b* of the plunger 91 comes into engagement with the lock portion 60*b* of the regulating member 60. Further, in the illustrated embodiment, the throttle actuating member 70 and the shift actuating member 52 have axes that are generally parallel to one another, thereby allowing the regulating member C to be easily mounted onto the engine 10 from the same direction and ensuring smooth actuation.

The mechanical structure discussed above in connection with certain preferred embodiments provides a structure that interferes with shift operation when the throttle is above a predetermined opening D1. It is to be understood that structures other than that discussed above can be employed. For example, a structure may be employed utilizing a cam that looks and even operates much differently than the cam member 87 discussed above. Further, rather than employing a cam, additional members may be provided that are attached to throttle cables, the throttle link, and/or other members and devices and which may be arranged to mechanically interfere with shift operation at certain throttle settings. Accordingly, the principles of the present invention need not be limited to the embodiments specifically described above.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention.

Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An outboard motor comprising an engine, a throttle mechanism, a shift mechanism, and a regulating mechanism, the throttle mechanism adapted to control a throttle opening of the engine, the shift mechanism configured to change a shift position of the outboard motor between at least a neutral state and a forward state, the regulating mechanism configured so that when the shift mechanism is set to the neutral state and the throttle mechanism is set so that the throttle opening exceeds a predetermined value, the regulating mechanism restricts the shift mechanism from shifting out of the neutral state but permits unrestrained operation of the throttle mechanism, the regulating mechanism further configured so that when the shift mechanism is set to a state other than the neutral state operation of the throttle mechanism remains unrestrained wherein the throttle mechanism comprises a cam member having a cam portion, the cam member adapted to rotate with a portion of the throttle mechanism, a plunger operatively connected to the cam portion and adapted to move linearly as the cam member rotates, and the shift mechanism has a regulating member having an engagement portion, wherein the plunger is adapted to engage the engagement portion when the shift mechanism is in the neutral state and the throttle mechanism is rotated to a position beyond a predetermined setting corresponding to the throttle opening predetermined value.

2. An outboard motor as in claim 1, wherein the regulating mechanism does not restrict operation of the throttle mechanism in all states of the shift mechanism.

3. An outboard motor as in claim 1, wherein the outboard motor comprises a cowl that encloses at least part of the regulating mechanism, at least part of the throttle mechanism, and at least part of the shifting mechanism.

4. An outboard motor as in claim 3, wherein a portion of the throttle mechanism within the cowl rotates about an axis, and a portion of the shift mechanism within the cowl rotates about an axis, and the throttle mechanism axis and shift mechanism axis are generally parallel to one another.

5. An outboard motor as in claim 3, wherein the throttle mechanism is configured to be controlled by a throttle interface, the throttle interface being disposed outside of the cowl.

6. An outboard motor as in claim 5, wherein the shift mechanism is configured to be controlled by a shift interface, the shift interface being disposed outside of the cowl.

7. An outboard motor as in claim 1, wherein the cam portion is configured so that the plunger does not move substantially linearly when the throttle mechanism is rotated to a position beyond the predetermined setting corresponding to the throttle opening predetermined value.

8. An outboard motor as in claim 1, wherein the plunger does not engage the engagement portion when the shift mechanism is not in the neutral state, but is positioned to interfere with the regulating member when the throttle mechanism rotates beyond a predetermined setting corresponding to the throttle opening predetermined value.

9. An outboard motor as in claim 1, wherein a portion of the throttle mechanism rotates about an axis, and a portion of the shift mechanism rotates about an axis, and the throttle mechanism axis and shift mechanism axis are generally parallel to one another.

10. An outboard motor comprising an engine, a throttle mechanism, a shift mechanism, and a regulating mechanism, the throttle mechanism adapted to control a throttle opening of the engine in response to a throttle operation means, the shift mechanism configured to change a shift position of the outboard motor between at least a neutral state and a forward state in response to a shift operation means, the regulating mechanism configured so that when the shift mechanism is set to the neutral state and the throttle mechanism is set so that the throttle opening exceeds a predetermined value, the regulating mechanism restricts the shift mechanism from shifting out of the neutral state but permits unrestrained operation of the throttle mechanism, the regulating mechanism further configured so that when the shift mechanism is set to a state other than the neutral state operation of the throttle mechanism remains unrestrained, wherein the throttle mechanism comprises a cam member having a cam portion, the cam member adapted to rotate with a portion of the throttle mechanism, a plunger operatively connected to the cam portion and adapted to move linearly as the cam member rotates, and the shift mechanism has a regulating member having an engagement portion, wherein the plunger is adapted to engage the engagement portion when the shift mechanism is in the neutral state and the throttle mechanism is rotated to a position beyond a predetermined setting corresponding to the throttle opening predetermined value.

11. An outboard motor as in claim 10, wherein the regulating mechanism comprises means for interfering with operation of the shift mechanism.

12. An outboard motor as in claim 11 additionally comprising means for selectively actuating the interfering means only when the throttle opening exceeds the predetermined value.

* * * * *